US005223697A

United States Patent [19]

Wilde et al.

[11] Patent Number: 5,223,697

[45] Date of Patent: Jun. 29, 1993

[54] ELECTRIC RADIANT HEATER

[75] Inventors: Eugen Wilde, Knittlingen; Erich Wagner, Oberderdingen; Leonhard Doerner, Oberderdingen; Robert Kicherer, Oberderdingen, all of Fed. Rep. of Germany

[73] Assignee: E.G.O. Elektro-Gerate Blanc u. Fischer, Fed. Rep. of Germany

[21] Appl. No.: 803,204

[22] Filed: Dec. 6, 1991

[30] Foreign Application Priority Data

Dec. 11, 1990 [DE] Fed. Rep. of Germany ..... 4039501

[51] Int. Cl.[5] ..... H05B 3/74

[52] U.S. Cl. ..... 219/464; 219/518

[58] Field of Search ..... 219/448, 449, 451, 452, 219/464, 518

[56] References Cited

U.S. PATENT DOCUMENTS

| | | | |
|---|---|---|---|
| 4,334,135 | 6/1982 | Smith | 219/518 |
| 4,394,565 | 7/1983 | Dills | 219/542 |
| 4,447,710 | 5/1984 | McWilliams | 219/449 |
| 4,577,181 | 3/1986 | Lipscher | 219/518 |
| 4,778,978 | 10/1988 | Schreder | 219/464 |
| 4,808,798 | 2/1989 | Goessler | 219/464 |
| 4,810,857 | 3/1989 | Goessler | 219/464 |
| 4,851,645 | 7/1989 | Wolf | 219/464 |
| 5,049,726 | 9/1991 | Higgins | 219/464 |

FOREIGN PATENT DOCUMENTS

| | | |
|---|---|---|
| 238331 | 2/1965 | Austria . |
| 0211484 | 2/1987 | European Pat. Off. . |
| 0442275 | 1/1991 | European Pat. Off. . |
| 7132382 | 8/1971 | Fed. Rep. of Germany . |
| 2551137 | 5/1977 | Fed. Rep. of Germany . |
| 2760339 | 1/1979 | Fed. Rep. of Germany . |
| 3008505 | 9/1981 | Fed. Rep. of Germany . |
| 3129239 | 2/1983 | Fed. Rep. of Germany . |
| 3219392 | 12/1983 | Fed. Rep. of Germany . |
| 8702714 | 4/1987 | Fed. Rep. of Germany . |
| 3703768 | 8/1988 | Fed. Rep. of Germany . |
| 3711589 | 10/1988 | Fed. Rep. of Germany . |
| 3735179 | 5/1989 | Fed. Rep. of Germany . |
| 3804170 | 8/1989 | Fed. Rep. of Germany . |
| 4005128 | 8/1990 | Fed. Rep. of Germany . |
| 264208 | 1/1989 | German Democratic Rep. . |
| 1433478 | 4/1976 | United Kingdom . |
| 2044057 | 10/1980 | United Kingdom . |
| 2197169 | 5/1988 | United Kingdom . |
| 2228732 | 9/1990 | United Kingdom . |

*Primary Examiner*—Teresa J. Walberg
*Attorney, Agent, or Firm*—Quarles & Brady

[57] ABSTRACT

The rim of an electric radiant heater is formed by a multilayer body (13). It can have the cross-sectional shape of a U, whose interior is filled with a good insulating material. In the interior (23) is placed a sensor coil (23) for a pot detection system, where it is well shielded against heat and mechanical influences.

17 Claims, 2 Drawing Sheets

ELECTRIC RADIANT HEATER

DESCRIPTION

1. Field of the Invention

The invention relates to an electric heater, particularly a radiant heater with a natural, thermal boundary insulation.

2. Background of the Invention

The not previously published EP 442 275 A2 (corresponding to U.S. application Ser. No. 650 489 of Feb. 5 1991) discloses a radiant heater, in whose outer rim is inserted in an outwardly open slot a sensor coil of a pot detection system.

DE 37 35 179 A1 discloses a multilayer marginal construction of a radiant heater.

SUMMARY OF THE INVENTION

An object of the invention is to provide an electric heater, whose natural boundary can be easily produced in the case of good strength and thermal insulation.

An induction coil passing round the radiant heater is embedded in the edge or rim. This can take place in the interior of a U-shaped marginal cross-section, which is then filled with another insulating material or the coil can also be pressed in. It is therefore possible to insulate said coil against the main thermal influence, but to fit it close to the glass ceramic plate, accompanied by a simultaneous electrical insulation. Its leads and the remaining heating element leads can also be led out in the vicinity of edge cutouts, which can be pressed directly into the shaped body. A connecting member can also extend directly into the vicinity of a marginal cutout. Fixing can take place by snapping or bending in connection, as well as by a claw engagement of a punched out tab of a support tray or shell.

The lateral boundary insulation, i.e. the insulation of the marginal area of the heater, which is usually circular, can be subdivided into several layers graded in accordance with the desired characteristics. Thus, for example, the mechanically more highly stressed sides, e.g. the inside directed towards the radiant heating area, can be made from a mechanically stronger layer and also on the outer circumference a somewhat more strong layer could be provided, so that the ring can easily be handled and fitted. However, on the inside can be fitted a mechanically less strong, but good thermally insulating layer. The individual layers could also be reflectively coated or have interposed reflection foils. Coating can take place metallically and/or by other reflection media, e.g. metal oxides, which act in a reflecting manner in the mainly occurring wavelength range.

The edge or rim could e.g. be a vermiculite body with a U-shaped cross-section, which is closed on the top surface facing a glass ceramic plate and with its two legs rests on the remaining insulation of the radiant heater. The interior can be an air space or chamber, or could also be lined with a good insulating bulk material or the like. It can also be manufactured from tubular portions with a sandwich-like construction. A horizontal layer construction can be provided, if it is mainly a question of giving high mechanical strength to the layer towards the radiation side.

This leads to an edge or rim construction, which combines an excellent insulation with good surface strength. The remaining insulation can be largely planar and therefore can be manufactured relatively easily with good thermal insulation characteristics. Through the arrangement of the layers it is possible to influence the thermal conductivity profile. Thus, for example, a bridge between the layers, e.g. the U-legs of a profile, can be positioned close to the glass ceramic plate, so that the heat transmitted there can be preferably dissipated through the glass ceramic plate. The shape and dimensional stability makes it possible to fit the edge in the support tray without special adaptation measures. It can also secure the remaining heater insulation in the support tray. Manufacture with continuous transitions between the insulating layers is also possible. Thus, by corresponding blowing or foaming of the insulating material in the mold, a structure similar to an integral foam can be obtained, in which the surface is denser and towards the center the volumetric weights decrease and consequently the insulating characteristics increase.

Advantageously the insulator can be wholely or partly provided with an outer layer of a mechanically stronger material, e.g. vermiculite, which can optionally replace the otherwise conventional sheet metal support tray and is consequently a self-supporting, relatively wear-resistant sleeve, which also forms the support point for the terminals, temperature sensors, etc. It can be a separate shaped or molded article, into which are pressed the other insulating materials, but pressing can simultaneously take place with the remaining insulating material and in the interfaces between the interfacing materials there can be desired penetrations or insulating of said materials. This leads to a substantially continuous transition between said materials, which ensures a good interengagement of the layers.

It is also possible to use mixtures of insulating materials, particularly vermiculite with pyrogenic silica aerogel, both of which can be molded dry and which lead to a thermally good insulating, but mechanically stronger material than the aerogel alone. Preferably in one piece with a marginal layer, it would be possible to produce from said material a support layer carrying the heating resistors. They can be fixed thereon in a random manner, the method of EP 355 388 A1 being particularly preferred and reference should be made to this specification for further details.

BRIEF DESCRIPTION OF THE DRAWINGS

These and further features can be gathered from the claims, drawings and description and the individual features, either singly or in the form of random subcombinations, can be realized in an embodiment of the invention and in other fields and can represent advantageous, independently protectable constructions for which protection is hereby claimed. Preferred embodiments of the invention are described in greater detail hereinafter relative to the drawings, wherein:

DETAILED DESCRIPTION OF THE PREFERRED EMBODIMENTS

Figure 1:
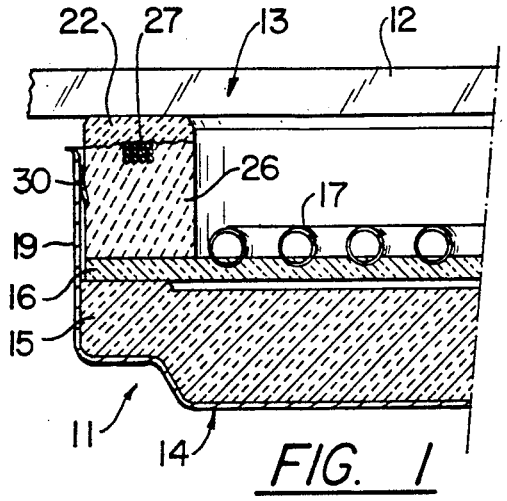
FIGS. 1 to 7 shows several variants of heaters, in each case in part sectional form.

FIG. 1 shows an electric radiant heater 11, which is fitted under a glass ceramic hotplate 12 and which is pressed with a boundary insulation 13 on its underside. In a support tray 14 is provided a lower insulating layer 15, which is formed by a pyrogenic silica aerogel poured into and then molded in the sheet metal support tray 14. This insulating material has good thermal stability and good heat insulating characteristics, but is not very mechanically strong. On the insulating layer 15 is provided a further insulating layer 16 made from a mechanically stronger insulating material, e.g. a fibrous material commercially available under the trade name "Fiberfrax", or some other ceramic fibrous material, which is molded with binders. In said layer 16 are embedded with their lower tips heater coils 17 made from an electrical resistance material and this mainly takes place at a clearly defined distance from the glass ceramic plate 12 on which cooking vessels can be placed. However, the heater is also suitable for other heating purposes, e.g. for the radiant heating of ovens or for the heating of other objects, e.g. metal hotplates.

The radiant area 18 formed over the heating resistors 17 is surrounded by the boundary insulation 13 which forms a rim passing round the heater which projects somewhat above the sheet metal support tray rim 19 and consequently provides the contact with the glass ceramic plate.

The boundary insulation 13 has a horizontal layer system. It comprises an annular shaped body, which on its top surface facing the radiation side, e.g. engaging on the glass ceramic plate, has a stronger layer 22 of molded vermiculite, whereas the remainder 26 of the shaped body which takes up most of the ring height can comprise a mixture of vermiculite, pyrogenic silica aerogel and reinforcing fibers. Into the area of the interface between the layers 22 and 26 is pressed a sensor coil 27 of an oxidation-insulated aluminum wire, which passes round the rim or edge and is therefore relatively closely positioned below the glass ceramic plate, but is thermally shielded. It constitutes the sensor of a pot detection means which, on changing the induction in the coil 27 as a result of an engaged pot, detects the same and switches on the radiant heater.

The boundary insulation can be produced in that firstly vermiculite with corresponding binder is introduced into a channel-shaped depression, followed by the engagement of the coil thereon and finally the insertion of the material forming the part 26 and the molded or compression of the complete entity.

Figure 10:
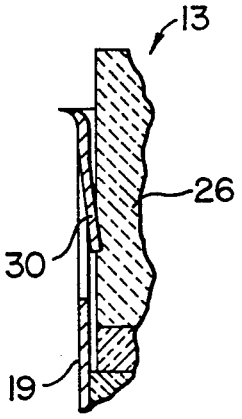
FIG. 10 shows construction of the fixing of the boundary insulation.

It can be seen that from the material of the rim 19 of the support tray 14 is punched out a sheetmetal tab 30, which is bent inwards somewhat, gives way resiliently on inserting the ring, but with its downwardly directed free edge is embedded in barb-like manner in the boundary insulation material and consequently secures the same in the support tray (cf. FIG. 10).

Figure 2:
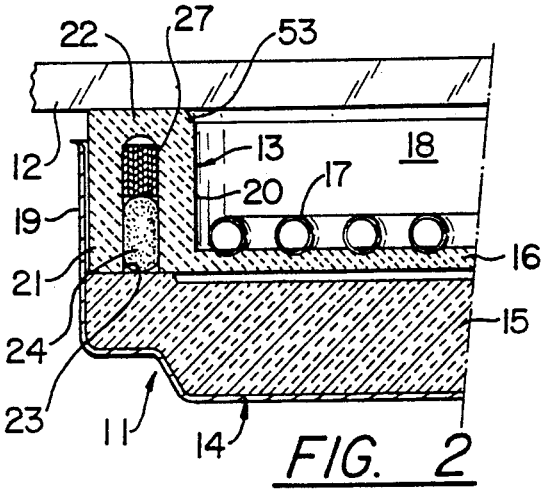

In the case of FIG. 2 the boundary insulation 13 is formed from a shaped body made from molded vermiculite. It is mixed in granular form with a binder, molded, as is described in DE-U-87 02 714, to which reference should be made for further details. The cross-section of the shaped body is inverted U-shaped, so that the boundary insulation 13 has an inner leg 20, an outer leg 21, an upper connecting portion 22 and an elongated inner ring recess 23 in the vertical direction. The sensor coil 27 is placed in its upper part, where it is once again close to the glass ceramic plate. The remainder of the ring recess 23 is again filled with insulating material. The sensor coil 27 comprises a spiral winding of flat, strip-like, oxide-insulated line material, similar to a tight watch spring. The conductor strips are vertical. This winding mode allows a considerable density of the coil body, accompanied by limited losses. The walls, particularly in the interior of the ring recess 23, can be given a reflecting coating, e.g. by metal vapor deposition or by applying reflecting metal oxides, so that radiant heat transfer through the ring recess 23 is prevented. The ring recess 23 in the boundary insulation 13 is filled with an insulating material filling 24, whose material differs from that of the U-shaped body. It can in particular be the same material as the lower insulating layer 15 or an even lighter and better insulating material, which is filled into the ring recess and is optionally pressed somewhat into it so as to make the ring easier to handle. A string of ceramic fibers is used in FIG. 2. Therefore the insulation is much better than would be the case with a solid shaped body. The only point where the shaped body passes from the inside to the outside is in the vicinity of the connecting portion 22, where the heat can easily be dissipated through glass ceramic plate 12.

It can be seen that the shaped body forming the boundary insulation is a stable body which can be manufactured with sharp boundary faces, which contains on the upper inside a bevel 53 so as to form a boundary face protected against notches. The annular boundary insulation also secures the insulating layers 15, 16 and presses them into the support tray 14.

The radiant heater is also eminently suitable for the use of quartz-encapsulated high temperature heating radiators, such as e.g. tungsten halogen lamps. Here again in single-layer insulation can be chosen, where the upper insulating layer 16 is avoided. The heater coil 17 and boundary insulation 13 are then directly placed on the insulating layer 15, being positioned on the surface thereof and can e.g. be fixed there by metal clips.

Figure 3:
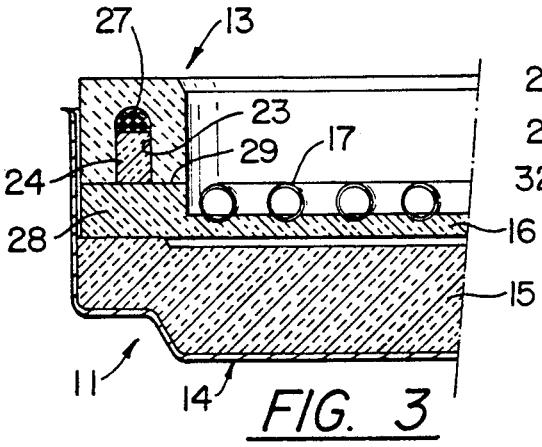

FIG. 3 shows a marginal construction with a shaped body as in FIG. 2, but with a round wire coil 27 and a pressed in bulk material insulation 24 filling the recess 23. The insulating layer 16 has a raised marginal area 28, which is roughly level with the top of the heater coils 17. Therefore the insulating layer 16 can be more easily produced, because with the pressed-in heater coils it can be placed flat on a dry plate, without deformations having to be feared.

Figure 4:
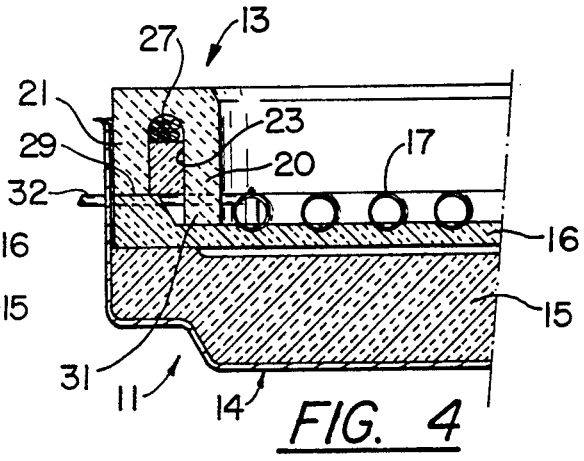

In the interface 29 between the insulating layer 16 and the boundary insulation 13 can be led out the connecting lines of the heating resistors 17, as shown in FIG. 4. However, in the latter the U-cross section of the boundary insulation, otherwise corresponding to FIG. 3, is unequal-sided, in that the inner leg 20 is longer than the outer leg. Thus, the inner leg 20 has recesses 31 pressed onto its underside and through which can pass the connecting lines 32.

Figure 5:
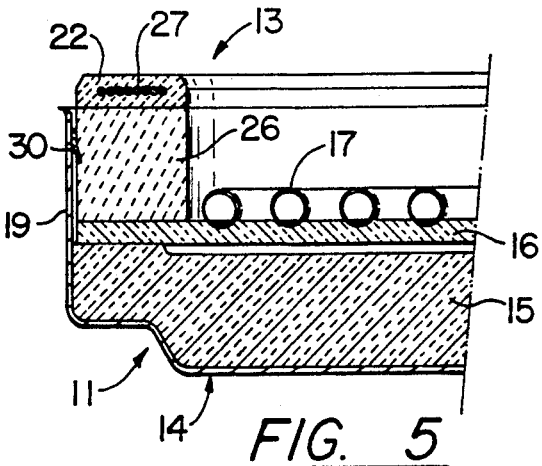

FIG. 5 shows a circular rim 26, made from insulating material and without an inner recess. On it rests a flat ring 22 made from a mechanically stronger insulating material, e.g. vermiculite, in which is embedded a flat, circular sensor coil formed from juxtaposed wires. It not only provides an ideal protection for the coil, but also for the upper surface of the rim 26.

Figure 6:
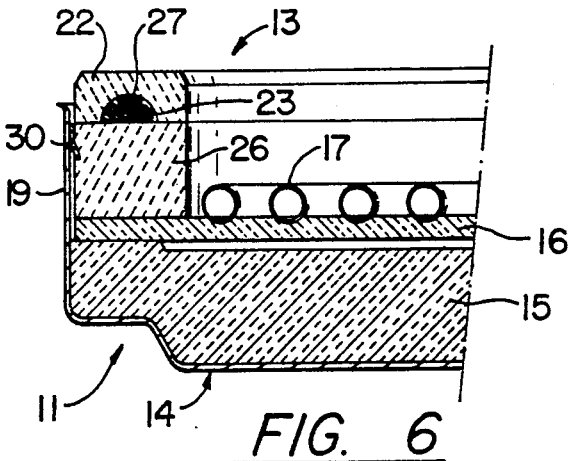

FIG. 6 shows a similar ring 22 with a recess 23, in which a conventional coil rests on the surface of the rim 26, i.e. is embedded or enclosed in the boundary face of the rim 26 and the ring 22.

Figure 7:
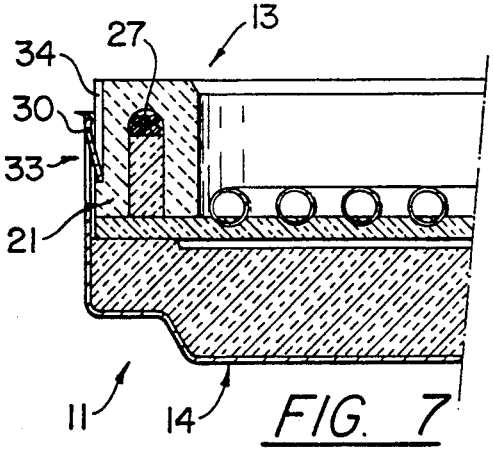
Figure 9:
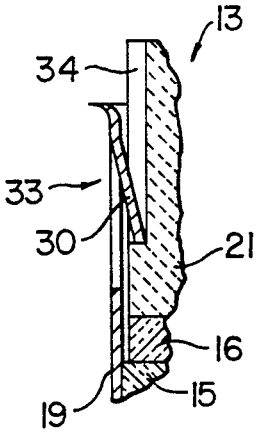
FIG. 9 shows a detail of FIG. 7.

FIG. 7 shows a construction with a boundary insulation corresponding to FIGS. 3 and 4. There is a snap connection 33 between the tray rim 19 and the boundary insulation 30, which comprises a downwardly sloping and inwardly projecting, resilient tab 30, which is pressed back on pressing in the boundary insulation 13 and then drops into slots 34 shaped onto the outer circumference of the leg 21 and which only extend over part of the height (detail see FIG. 9).

Figure 8:
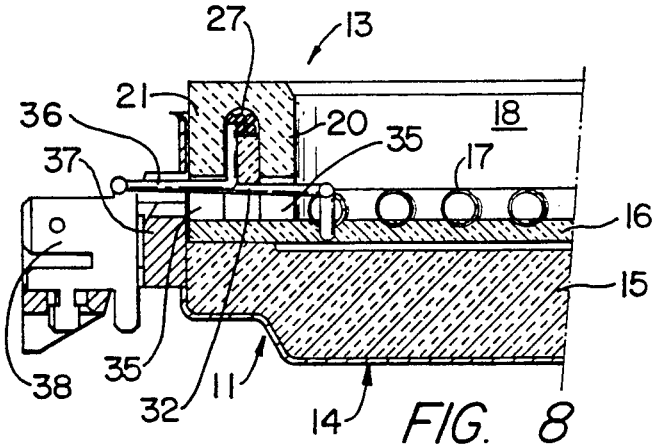
FIG. 8 shows a part section through the embodiment of FIG. 7 in the connection area.

FIG. 8 shows the construction according to FIG. 7 at the point at which the connecting lines for the heater coils 17 and the sensor coil 27 are led to the outside. It can be seen that there the two legs 20, 21 of the shaped body have recesses 35, through which can project to the outside the connecting lines 32 of the heater coil 17 and the sensor coil connecting wires 36. They lead to a connector 37, which has flat plug tongues 38 for the leads. The connector is fixed to the support tray, but can also engage in a recess 35 of the boundary insulation 13. Any temperature sensors of temperature limiting and regulating means extending through the radiation area 18 can also be passed through recesses in the boundary insulation. It can be seen that the relatively shape stable, but still good insulating rim provides an ideal possibility of leading the terminals to the outside, it being possible to form the recesses when shaping the rim. This greatly facilitates fitting, together with a good dimensional and shape stability.

Figure 11:
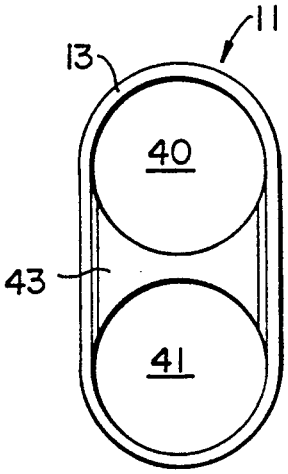
FIG. 11 shows a diagrammatic plan view of a two-circuit heater.

FIG. 11 is a plan view of a two-circuit heater, in which optionally separate control or regulatable circular heating zones are combined to form an oval or slot-like plate. The two zones 40, 41 are separated from one another by a central portion 43 which, like the oval outer rim 13, can be built up in multilayer form in the manner of the previously described boundary insulations. Thus, e.g. the double concave central portion 43 can have a single or double-U-shaped profile, in which can be optionally placed other sensors as pot detection sensors, e.g. temperature sensors or the like.

In connection with the manufacturing process it is pointed out that the sensor coil 27 can be shaped during the manufacture of the shaped article, e.g. in the construction according to FIGS. 2 to 4. Thus, the coil can e.g. be wound onto the front edge of a molded core, which is placed in a channel-like mould and moulds the recess 23. After moulding it is drawn out and leaves the coil in the recess. This preferred production process leads to a particularly good embedding of the sensor coil 27 just below the glass ceramic plate.

Figure 12:
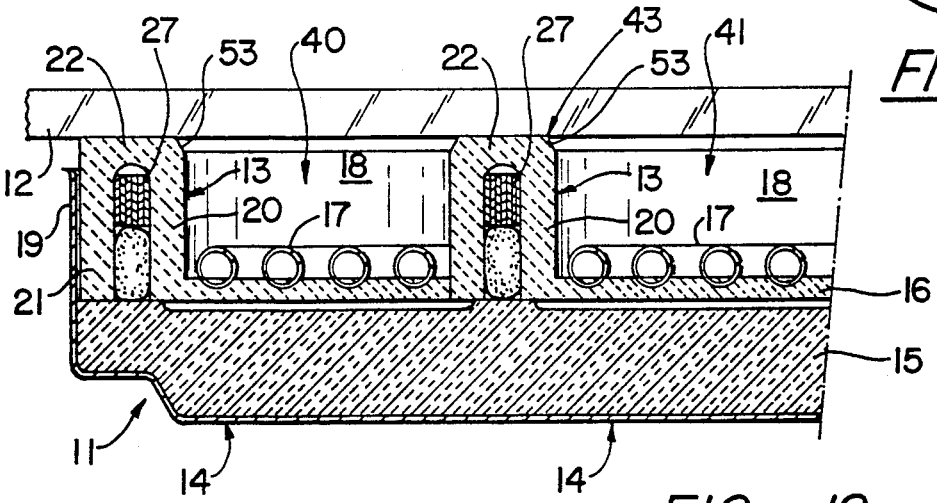
FIG. 12 shows a part section through a two-circuit heater.

FIG. 12 shows a section through a two-circuit heater 11 corresponding to FIG. 11. It can be seen that the central web 43 can carry an arm of a sensor coil 27, which is here constructed in accordance with FIG. 2. With a concentric arrangement of the heating zones 40, 41, only the rim forming the boundary insulation 13 of the inner heating zone need be provided with a sensor coil 27.

The sensor coil is connected to a pot detection system operating with an induction measuring principle. If, on engaging the pot, the loading of the induction coil changes, then the radiant heater is switched on. As the coil inductance values change in the case of temperature variations, a very good thermal shielding of the coil is important, also for the choice of a favorable coil material. Although admittedly good pot detection systems, e.g. according to EP 442 275 A2 (corresponding to U.S. Ser. No. 650,489) bring about a good compensation for the temperature-caused drift of the coil values, the function is improved by the good thermal shielding.

On removing the pot the induction values change again and the pot detection system acts on the heater control for disconnection purposes.

I claim:

1. An electric radiant heater for heating a plate, said heater comprising:

a heating element and a thermal boundary insulation, which peripherally surrounds and defines a heater interior in which said heating element is at least partially disposed, the boundary insulation enclosing a sensor coil for detecting cooking vessels placed on the plate, wherein the boundary insulation is a ring and has a substantially U-shaped cross-section with two legs forming an annular space between the U-legs, said space containing the sensor coil and being plugged by an insulating media, the annular space being closed towards the emission side of the radiant heater.

2. An electric radiant heater for heating a plate, said heater comprising:

a heating element and a thermal boundary insulation, which peripherally surrounds and defines a heater interior in which said heating element is at least partially disposed, the boundary insulation enclosing a sensor coil for detecting cooking vessels placed on the plate, wherein an outer insulating layer of the boundary insulation on a side directed towards the outside of the radiant heater projects less far downwards where an insulating layer rests on a raised marginal area at a height line and at said height line recesses are provided in the boundary insulation.

3. An electric radiant heater for heating a plate, said heater comprising:

a heating element and a thermal boundary insulation, which peripherally surrounds and defines a heater interior in which said heating element is at least partially disposed, the boundary insulation enclosing a sensor coil for detecting cooking vessels placed on the plate, wherein the boundary insulation comprises molded together insulating layers with an embedded sensor coil, a layer directed towards the plate being made from mechanically stronger material, and the layer connected thereto being made from a less strong, but better thermally insulating material containing pyrogenic silica aerogel with additives and vermiculite.

4. The heater according to claim 3, wherein the insulating layers form a transition zone by joint molding in their boundary regions, said transition zone including insulation materials used in both layers.

5. An electric radiant heater for heating a plate, comprising:

a base insulation layer;

a heating element operationally connected to said base insulation layer; and a thermal boundary insulation peripherally surrounding and defining a heater interior in which said heating element is at least partially disposed, said boundary insulation enclosing a sensor coil for detecting cooking vessels placed on the plate, said boundary insulation forming a separate ring of insulating material, whereby said sensor is thermally shielded against heat in all directions, said boundary insulation being placed on a marginal portion of said base insulation layer.

6. The heater according to claim 5, wherein the boundary insulation includes a plurality of insulating layers.

7. The heater according to claim 5, wherein the boundary insulation incorporates a shaped body, which comprises pressed material from a group containing vermiculite.

8. The heater according to claim 7, wherein recesses for electric leads are shaped into the shaped body.

9. The heater according to claim 5, wherein the boundary insulation is connected with a rim of a support tray surrounding the radiant heater by at least one of a snap-in, bend-in or barb-like clawing means.

10. The heater according to claim 5, wherein the boundary insulation is bevelled on a side directed towards the plate at an edge facing the heater interior.

11. according to claim 5, wherein the boundary insulation comprises a central portion between two separately controllable or regulatable heating zones with in each case a heater interior.

12. The heater according to claim 5, wherein an insulating material layer of the boundary insulation is constructed in one piece with a support layer carrying heating resistors.

13. The heater according to claim 5, wherein at least two insulating materials are jointly dry moulded, the heating resistor coils partly also being moulded in.

14. The heater according to claim 5, wherein the sensor coil comprises a winding of a flat conductor band.

15. The heater according to claim 5, wherein said ring has flat peripheral surfaces.

16. The heater according to claim 5, wherein said ring contains a separating surface between two layers of different insulating materials which form the ring, said sensor coil crossing said separating surface.

17. The heater according to claim 5, wherein the sensor coil has an axis and contains several windings juxtaposed in a curved plane radial to said axis.

* * * * *